United States Patent [19]

Borden et al.

[11] Patent Number: 5,054,777

[45] Date of Patent: Oct. 8, 1991

[54] GOLF ACCESSORY

[76] Inventors: Teddy H. Borden, 315 W. Braeside, Arlington Heights, Ill. 60004; Prithvi P. Singh, 2919 Floral, Northbrook, Ill. 60062

[21] Appl. No.: 640,104

[22] Filed: Jan. 11, 1991

[51] Int. Cl.[5] ..... A63B 57/00

[52] U.S. Cl. ..... 273/32 B; 15/113; 15/160; 224/918; 206/315.1; 150/161; 172/380

[58] Field of Search ..... 273/32 R, 32 A, 32 B, 273/162 D, 162 F; 15/113, 160; 206/315.1; 224/918; 150/161; 172/380

[56] References Cited

U.S. PATENT DOCUMENTS 3,556,364 1/1971 Maretka ..... 273/32 A X
3,622,157 11/1971 Hatch ..... 273/32 B X
4,129,237 12/1978 Grinder ..... 273/32 A X

FOREIGN PATENT DOCUMENTS 2219513 12/1989 United Kingdom ..... 273/32 B

*Primary Examiner*—George J. Marlo
*Attorney, Agent, or Firm*—Michael J. Femal

[57] ABSTRACT

An elegant golf accessory combines a divot repair, a holding base for receiving the prongs of the divot repair, a ball marker with a snap member passes through a hole on the divot repair when the prongs are inserted into the base and snaps into a receptacle in the base to lock the divot repair and base together into a single, attractive carrying unit. The finger gripping portion or the divot repair includes a brush mounted on its head with a slidable cover thereover.

6 Claims, 1 Drawing Sheet

Fig. 1
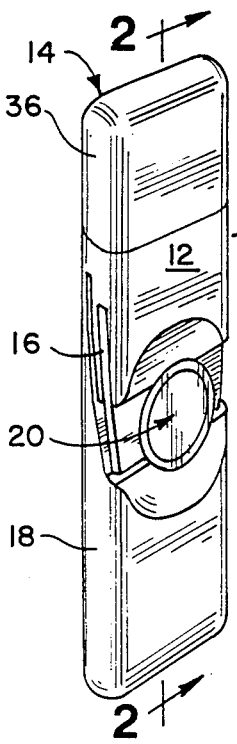
Fig. 2
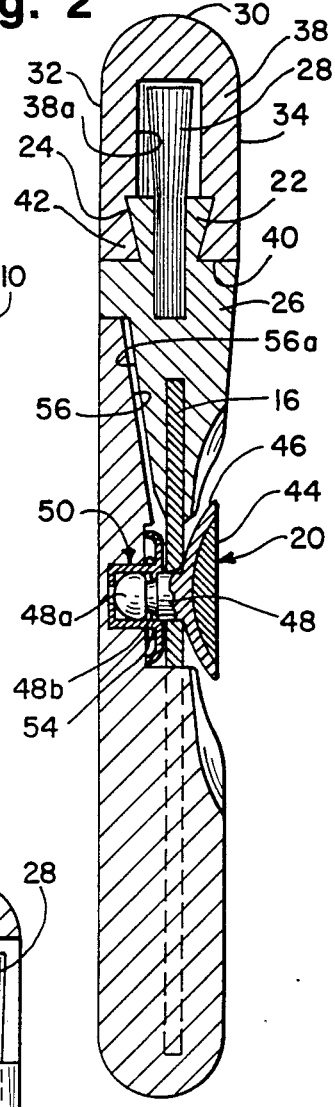
Fig. 3
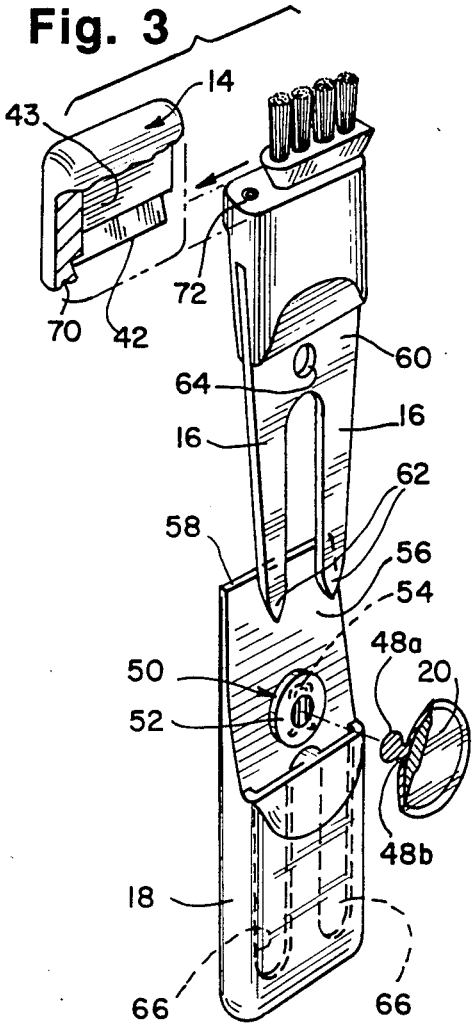
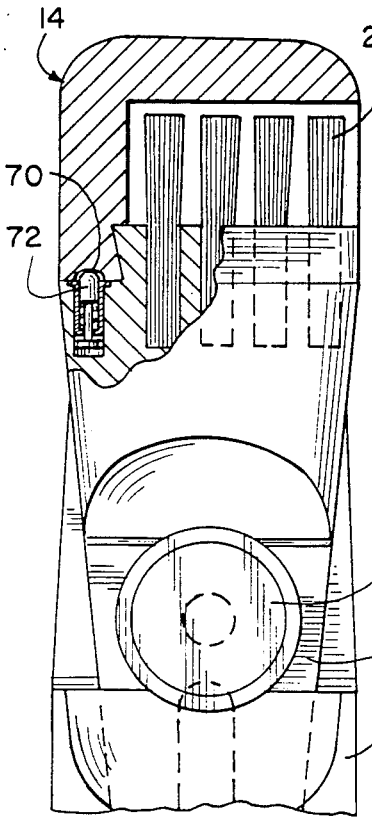
Fig. 4
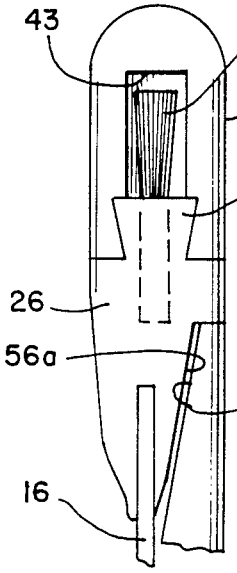
Fig. 5

GOLF ACCESSORY

BACKGROUND OF THE INVENTION

This invention relates to a golf accessory and, more particularly to a golf accessory which packages several useful items such as a ball marker, a divot repair tool and brush together to form an attractive single carrying unit.

Before the application was filed, the applicants were aware of the following U.S. Pat. No. Des. 237,516 Yaudes; 1,788,177 Traute; 3,620,426 Hatch; 3,622,157 Hatch; 4,129,237 Grinder; 4,151,937 Jarosh et al.; 4,535,987 Dikoff; 4,736,877 Clark; and 4,960,239 Clark.

In order to play the sport of golf, a golfer needs a number of accessories to follow the proper etiquette of marking the ball on the green and repairing divots on the greens from approach shots. Also, the ball and the face of the clubs pick up loose grass and dirt on the course which can result in missed putts or errant shots on the fairway. A brush to clean the ball and club face becomes an important function of a golf accessory if one is to putt and hit the golf ball properly. The other problem with many golf accessories is that they have sharp points exposed like divot repair tools which poke holes in golf slacks and prick fingers and legs when reaching into pockets to retrieve them for use. Moreover, ball markers often get lost or come loose from other combination of ball markers and divot repairers.

In addition, many prior art golf tools including a ball marker and divot repairer beside having sharp exposed edges or points with insecurely mounted ball markers thereon when fully assembled for carrying, are generally unattractive and cumbersome looking from an aesthetic viewpoint.

Accordingly, one of the objects of the present invention is to provide a combination golf tool accessory that assembles into a single carrying unit without sharp exposed edges or protruding points but yet is designed to be versatile and aesthetically pleasing to look at.

Another object of the present invention is to provide a golf accessory that is the ultimate in practical design and elegance that a golfer is comfortable in using and showing fellow golfers either on a public or private golf course. Instead of fishing out of a pocket one of the ordinary golf ensembles as shown in the prior art patents, the present invention provides a golfer with a handsome and uniquely shaped golf accessory that one would be proud to show his golfing buddies.

SUMMARY OF THE INVENTION

These and other objects of the present invention are achieved in the provision of a golf accessory comprising a divot repair having a pair of prongs at one end and a generally rectangular bulbous body at the other end for gripping with the fingers of the golfer's hand. A generally rectangular holding base includes a pair of recesses extending from one end a predetermined distance toward the other end in a plane generally parallel to the longitudinal axis of the base corresponding to the spacing of the prongs for slideably receiving the prongs of the divot repair within said base. Both said body and base having a tapered back surface at the ends adjoining one another when the prongs of the divot repair are inserted into the recesses of the base. Said tapered surfaces mate with one another to form a generally flat back surface for the golf accessory. The prongs of the divot repair define a U-shaped space between the prongs and adjoin near the body at a generally flat prong surface having a hole therethrough. A ball marker includes a generally flat circular top surface and a convex underside having a snap member extending perpendicularly downward from the center of the convex underside. A receptacle for the snap member is generally centered in the tapered surface of the base and in vertical alignment with the hole in the flat prong surface when the the prongs of the divot repair are fully inserted into the holding base. Therefore, the snap member of the ball marker is inserted through the hole of the divot repair and snaps into the receptacle on the holding base for locking the divot repair and holding base together as a single carrying unit. The bulbous head of the divot repair includes a brush at the end opposite the prongs and a brush cover slideably attached to the head by a dovetail joint between the cover and head in a generally perpendicular direction to the longitudinal axis of the assembled divot repair and base. The cover includes a top, a front side, a back side and two ends with one end having an opening therein and a bottom having an opening defining a generally rectangular chamber therein for receiving the bristles of the brush to pass into the chamber of the cover when the cover is slideably engaged with the head. The head further includes a detent on the bottom adjacent the closed end for engaging a spring loaded ball on the top on the head to removably secure the cover on the head.

Other objects and benefits of the present invention will become apparent from the following written description and accompanying figures.

BRIEF DESCRIPTION OF THE DRAWINGS

FIG. 1 is a front elevation view of the golf accessory according to the features of the present invention.

FIG. 2 is a cross sectional view taken substantially along lines 2—2 of FIG. 2.

FIG. 3 is an exploded front elevation view of the golf accessory with the components removed from engagement with one another.

FIG. 4 is a partial front elevation showing the golf accessory assembled and components in phantom.

FIG. 5 is a partial side elevation of the golf accessory illustrating the divot repair, brush and its cover fully assembled.

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Turning now to FIG. 1, a golf accessory 10 of one embodiment of the present is shown. The golf accessory 10 includes a combination divot repair and brush unit 12 having a brush cover 14 at one end and a pair of divot repair prongs 16 at the other end slideably received within a holding base 18 with a ball marker 20 locking the combination divot repair and brush unit 12 together when inserted into the golf accessory 10.

Referring now to FIGS. 1, 2 and 3, a fan-shaped tenon 22 for a dovetail joint 24 extends upwardly from a finger gripping portion 26 of the divot repair. A row of bristles 28 of the brush are mounted and extend upwardly in a longitudinal direction from the portion 26 and through generally the center of the tenon 22. The brush cover 14 includes a rounded top 30, a generally flat backside 32, a generally flat front side 34, a generally curved left and right sides 36 and 38, said right side 38 having an opening 38*a*, a generally flat bottom 40 having a mortise 42 forming an opening 42*a* into a generally rectangular chamber 43 within the cover 14 for receiving the bristles 28 of the brush and said mortise 42 forming the tight interlocking dovetail joint 24 when slideably fitted with the corresponding tenon 22 on the gripping portion 26 as shown in FIG. 3. The ball marker 20 includes a flat circular top surface 44, a convex underside 46 and a snap member 48 extending perpendicularly downward from the center of the convex underside 46 and terminating in a bulbous end 48*a* with a circular groove 48*b* thereabove to be received in a receptacle 50 mounted on a tapered surface 56 at one end 58 of the holding base and said receptacle 50 having a recess 52 with a spring clip 54 fitted therein to engage the groove 48*b* on the snap member 48 locking the ball marker in place when inserted into the receptacle 50.

Referring now to FIG. 3, the prongs 16 join together at a flat end 60 opposite tips 62 and form a generally U-shaped space between the prongs 16. The flat end 60 includes a hole 64 generally centered on the flat end 60. The holding base includes a pair of longitudinally extending recesses 66 corresponding to the predetermined dimensions of the prongs 16 to slideably received the prongs 16 therein. Therefore, in the assembled state for the golf accessory 10, the prongs 16 are inserted into the recesses 66 on the base 18. The ball marker 20 has its snap member 48 extend through the hole 64 on the flat end 60 of the divot repair locking the divot repair and brush combination 14 in place so the tapered surface 56 on the holding base 18 mates with a tapered surface 56*a* on the divot repair and brush combination 14.

As shown in FIGS. 3 and 4, the brush cover 14 is slideably attached to the tenon 22. A detent 70 located on the bottom 40 of the cover 14 engages in a locking fashion with a spring loading ball 72 mounted within the body portion 26.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. A golf accessory, comprising:

a divot repair having a pair of prongs extending therefrom at one end and a gripping portion connected to the other end thereof, said divot repair having a hole located generally central thereon;

a holding base having a pair of recesses extending longitudinally therein corresponding in size and depth to a predetermined length of said prongs for slideably receiving the prongs therein, said base having a snap receptacle mounted thereon;

a ball marker having a snap member extending therefrom which passes through said hole on the divot repair and snaps into the receptacle on said base to interlock the divot repair to the holding base to form the assembled golf accessory wherein the tips of said prongs are concealed within the recesses of the base to prevent damage to pockets of golf slacks and the like.

2. The golf accessory of claim 1, wherein the gripping portion of the divot repair includes a brush mounted in the other end and a brush cover slideably attached to the other end in a direction perpendicular to the longitudinal axis of the assembled golf accessory.

3. The golf accessory of claim 1, wherein the brush cover includes a top, two sides, one side having an opening thereon and a generally flat bottom having an opening thereon and a chamber defined therein connected to the openings on the one side and the bottom for receiving said brush when then brush cover is slid onto the divot repair, a detent on the bottom thereof engaging a spring loaded ball mounted on the other end to releasably lock said cover in place on the divot repair.

4. A golf accessory, comprising:

a combination divot repair and brush having a brush mounted on one end and a brush cover slideably mounted over said brush in a releasably locking manner, a pair of prongs mounted to the other end, said prongs having a flat portion in which the prongs are joined together, said flat portion having a hole therein; a housing having a snap receptacle and a pair of recesses mounted at one end, said recesses corresponding to said prongs and having a predetermined depth to receive a portion of said prongs therein; and a ball marker having a snap member extending therefrom to pass through said hole when the prongs are seated within said recesses to lock the combination repair and brush to the housing.

5. The golf accessory of claim 4, wherein the brush cover includes a detent and the one end thereof includes a spring loaded ball to engage said detent to releasably lock the cover in place when slid to its seated position.

6. The golf accessory of claim 4, wherein the cover includes a mortise and the one end includes a fan-tailed tenon to form a tight fitting dovetail joint for attaching the cover over said brush.

* * * * *